US008100560B2

(12) United States Patent
Ahland, III et al.

(10) Patent No.: US 8,100,560 B2
(45) Date of Patent: Jan. 24, 2012

(54) SUBMERSIBLE HIGH ILLUMINATION LED LIGHT SOURCE

(75) Inventors: Walter W. Ahland, III, Mesa, AZ (US); Chris La Belle, Chandler, AZ (US); Thomas Kulaga, Chandler, AZ (US); Michael Kremer, Gilbert, AZ (US)

(73) Assignee: Lights, Camera, Action LLC, Mesa, AZ (US)

( * ) Notice: Subject to any disclaimer, the term of this patent is extended or adjusted under 35 U.S.C. 154(b) by 486 days.

(21) Appl. No.: 12/355,173

(22) Filed: Jan. 16, 2009

(65) Prior Publication Data

US 2009/0180281 A1 Jul. 16, 2009

Related U.S. Application Data

(60) Provisional application No. 61/021,433, filed on Jan. 16, 2008.

(51) Int. Cl.
*F21V 29/00* (2006.01)

(52) U.S. Cl. ... 362/267; 362/149; 362/247; 362/249.02; 362/294; 362/311.02; 362/101

(58) Field of Classification Search ..... 362/96, 362/101, 149, 227, 234–235, 247, 249.02, 362/253, 267, 294, 296.01, 311.02, 341, 362/362, 373, 509, 800
See application file for complete search history.

(56) References Cited

U.S. PATENT DOCUMENTS

| | | | | |
|---|---|---|---|---|
| 4,219,871 | A * | 8/1980 | Larrimore | 362/264 |
| 4,785,386 | A | 11/1988 | Denis et al. | |
| 5,105,346 | A | 4/1992 | Acks | |
| 5,213,410 | A | 5/1993 | Acks | |
| 5,386,355 | A | 1/1995 | Acks | |
| 5,800,041 | A * | 9/1998 | Poggi | 362/101 |
| 6,000,462 | A | 12/1999 | Gonner | |
| 6,635,989 | B1 | 10/2003 | Nilsson et al. | |
| 6,698,500 | B2 | 3/2004 | Noda et al. | |
| 7,175,329 | B1 | 2/2007 | Chou | |
| 7,265,807 | B2 | 9/2007 | Lifka et al. | |
| 7,303,301 | B2 | 12/2007 | Koren et al. | |
| 7,329,027 | B2 | 2/2008 | Phelan et al. | |
| 2004/0120156 | A1 * | 6/2004 | Ryan | 362/373 |
| 2005/0018435 | A1 | 1/2005 | Selkee et al. | |
| 2007/0139913 | A1 | 6/2007 | Savage | |
| 2008/0054280 | A1 | 3/2008 | Reginelli et al. | |

FOREIGN PATENT DOCUMENTS

| | | |
|---|---|---|
| FR | 2697617 | 5/1994 |
| JP | 2124183 | 5/1990 |

* cited by examiner

*Primary Examiner* — Stephen F Husar
*Assistant Examiner* — Meghan Dunwiddie
(74) *Attorney, Agent, or Firm* — Booth Udall, PLC

(57) ABSTRACT

A submersible high illumination light source assembly is disclosed, comprising at least one module. A module comprises a heat sink having a front surface and a rear surface. A printed circuit board comprising one or more electrical connections sized and shaped to couple with a plurality of high-illumination light emitting diode (LED) lamps is in thermal communication with the front surface of the heat sink. The plurality of high-illumination LED lamps are coupled in electronic communication with the printed circuit board via the one or more electrical connections. At least one reflector is sized and shaped to accept the insertion of one or more of the plurality of high-illumination LED lamps. A window is in watertight communication with the reflector plate. The submersible high illumination light source assembly operates both when submerged underwater and exposed to air.

23 Claims, 6 Drawing Sheets

SUBMERSIBLE HIGH ILLUMINATION LED LIGHT SOURCE

CROSS REFERENCE TO RELATED APPLICATIONS

This document claims the benefit of the filing date of U.S. Provisional Patent Application 61/021,433, entitled "Submersible High Power LED Light Source" to Ahland, et al. which was filed on Jan. 16, 2008, the disclosure of which is hereby incorporated entirely herein by reference.

BACKGROUND

1. Technical Field

Aspects of this document relate generally to submersible light sources.

2. Background Art

Many examples of underwater work environments exist, requiring adequate lighting for workers to efficiently and successfully perform their designated functions. One example of an underwater work environment exists within the context of nuclear power plants. Nuclear power plants conventionally include nuclear reactor cavities and spent fuel pools. Such nuclear reactor cavities and spent fuel pools, in operation, typically contain water or other liquid solutions. It is often required of workers performing maintenance, repair and other work in nuclear reactor cavities and spent fuel pools to work under water. Due to the inherently hazardous nature of underwater work in nuclear reactor cavities and spent fuel pools, along with the sensitive nature of the materials to be handled, extensive illumination is typically required for the safety of workers and others. Workers in other underwater environments, such as in oceanographic or other underwater work, also typically have considerable underwater lighting requirements.

In the case of nuclear power plant workers, underwater work may occur during the regular operation of the plant, or during outages when nuclear fuel is changed. In either case, there must be sufficient light in a nuclear reactor cavity and/or spent fuel pool order to allow workers to safely perform their functions which may include, by way of non limiting example, identifying serial numbers on fuel bundles using underwater cameras. Of course, the specific nature of the underwater functions to be performed by workers may vary, whether in a nuclear power plant, or in another underwater work environment.

Conventionally, lighting sources for underwater work environments may include the use of incandescent lamps or HPS lamps. Both incandescent lamps and HPS lamps conventionally operate using either 120 or 240 Volts of Alternating Current (AC). While this arrangement may allow both incandescent bulbs and HPS bulbs to be used in conventional electrical configurations, the use of AC may also increase the risk of bodily injury or death to workers, as compared to other electrical current configurations such as Direct Current (DC).

The conventional use of incandescent lamps in underwater work environments may present several shortcomings. In particular, incandescent lamps may need to be replaced after about every 200 hours of operation. Also, in the case nuclear reactor cavities and spent fuel pools, lamp replacement may typically require the labor of two workers due to safety requirements. During a lamp change in a nuclear reactor cavity or spent fuel pool, workers may be undesirably exposed to radiation. Additionally, due to labor, material and other expenses, the cost of replacing a conventional underwater incandescent bulb in nuclear reactor cavities and spent fuel pools may approach or exceed several hundred dollars. While incandescent bulbs are typically inexpensive to purchase initially, they nevertheless convert electricity into light energy inefficiently compared to other light sources such as, by way of non-limiting example, High Pressure Sodium (HPS) and may thus be comparatively expensive to operate.

Lighting sources for underwater work environments may also include the use of High Pressure Sodium (HPS) lamps. HPS lamps have conventionally been used in underwater work environments due to their efficient light output per watt (lumens per watt) as compared to other light sources such as, by way of non-limiting example, incandescent lamps. Nevertheless, various shortcomings may also exist with regard to the conventional use of HPS lamps in underwater work environments. In particular, HPS lamps may need to be replaced after every 18 months. Like conventional incandescent bulbs, replacement of HPS bulbs may also typically require the labor of two workers, due to safety requirements. During a lamp change, whether incandescent or HPS, workers may be exposed to radiation. Additionally, due to labor, material and other expenses, the cost of replacing a conventional underwater HPS bulb in nuclear reactor cavities and spent fuel pools may approach or exceed a thousand dollars. Further shortcomings may also exist with regard to the use of HPS bulbs. Specifically, HPS bulbs conventionally contain mercury. A mercury spill can be merely inconvenient in the case of oceanographic or other non-nuclear underwater work, or may be catastrophic when occurring in a nuclear reactor cavity or spent fuel pool. Typically, a nuclear power plant desiring to use HPS bulbs in nuclear reactor cavities and spent fuel pools may be required to develop burdensome plans that would provide for the recovery of mercury in the event of HPS lamp breakage. Moreover, while HPS bulbs convert electricity into light energy more efficiently than incandescent bulbs, they may still be expensive to operate.

When incandescent lamps and/or HPS lamps are used in nuclear reactor cavities and spent fuel pools, they may be exposed to gamma radiation and high temperatures. Typically, when incandescent and/or HPS bulbs used in nuclear reactor cavities and spent fuel pools require replacement, the discarded bulbs may be required to be disposed of as "radioactive waste," at significant expense, due to their prior contact with gamma radiation.

SUMMARY

Aspects of this document relate generally to submersible light sources.

In one aspect, a submersible high illumination light source assembly comprises at least one module. A module comprises a heat sink having a front surface and a rear surface. A printed circuit board is in thermal communication with the front surface of the heat sink and comprises one or more electrical connections sized and shaped to couple with a plurality of high-illumination light emitting diode (LED) lamps. The plurality of high-illumination LED lamps are coupled in electronic communication with the printed circuit board via the one or more electrical connections. At least one reflector sized and shaped to accept the insertion of one or more of the plurality of high-illumination LED lamps is provided and a window is in watertight communication with the reflector plate. The submersible high illumination light source assembly operates both when submerged underwater and exposed to air.

Particular embodiments of a submersible high illumination light source may include one or more of the following. A conformance coating on at least the printed circuit board may be provided. The heat sink may contain no copper. The rear surface of the heat sink may comprise a plurality of fins arranged in a vertical orientation. The at least one reflector may comprise a reflector plate comprising a plurality of dimples each sized and shaped to accept the insertion of the plurality of high-illumination LED lamps. The at least one reflector may comprise a plurality of individual reflectors, each sized and shaped to accept the insertion of one of the plurality of high-illumination LED lamps. The submersible high illumination light source assembly may further operate at about 40 volts, between about 5 amperes to about 12 amperes, and from about 200 watts to about 500 watts. The submersible high illumination light source assembly may operate at about 450 watts. The submersible high illumination light source assembly may further operate to produce a lumen total output from about 8,000 lumens to about 120,000 lumens. The submersible high illumination light source assembly may further operate to produce a lumen total output from about 40,000 lumens to about 50,000 lumens. The submersible high illumination light source assembly may further operate with an efficacy from about 40 lumens per watt to about 500 lumens per watt. The submersible high illumination light source assembly may further operate with an efficacy from about 40 lumens per watt to about 200 lumens per watt. A thermal paste may be provided between the front surface of the heat sink and a rear surface of the printed circuit board. A heat sensor may be operably coupled with the printed circuit board and a power control unit, the heat sensor may provide a temperature signal in response to a sensed temperature. The at least one module may comprise at least two modules one of coupled to and integrally joined with one another.

In another aspect, a method of operating a high illumination light source assembly comprises submerging in an underwater environment the high illumination light source assembly comprising at least one module. A module comprises a heat sink having a front surface and a rear surface. A printed circuit board is in thermal communication with the front surface of the heat sink and comprises one or more electrical connections sized and shaped to couple with a plurality of high-illumination light emitting diode (LED) lamps. The plurality of high-illumination LED lamps are coupled in electronic communication with the printed circuit board via the one or more electrical connections. At least one reflector sized and shaped to accept the insertion of one or more of the plurality of high-illumination LED lamps is provided and a window is in watertight communication with the reflector plate. The submersible high illumination light source assembly operates both when submerged underwater and exposed to air.

Particular embodiments of a submersible high illumination light source assembly may include one or more of the following. The step of submerging the high illumination light source assembly may comprise providing power to the high illumination light source assembly in an in-air environment and then submerging the high illumination light source assembly in an underwater environment while still providing power to the high illumination light source assembly. Alternatively, after submersion, the method may comprise providing power to the high illumination light source assembly. Regardless, the method may still further comprise removing from the underwater environment the high illumination light source assembly while still providing power to the high illumination light source assembly. The method may further comprise operating the high illumination light source assembly at about 40 volts and from about 200 watts to about 500 watts. The method may further comprise operating the high illumination light source assembly to produce a lumen total output from about 8,000 lumens to about 120,000 lumens. The method may further comprise operating the high illumination light source assembly with an efficacy from about 40 lumens per watt to about 500 lumens per watt.

All of the foregoing and other implementations of a submersible high illumination light source assembly may comprise or exhibit one or more of the following advantages. Implementations may provide illumination both in-air and underwater (and may be moved between in-air and underwater environments while operating), without requiring that a submersible light assembly unit is first powered down before being submerged, and/or removed from, an underwater environment. The duration between required lamp maintenance may be increased as the high-illumination LED lamps utilized in particular implementations may possess greater life-expectancy than other types of lamps. Cost savings in materials and labor may be realized due to the decreased maintenance required. Disposal costs of waste may decrease as fewer used lamps are generated at less frequent intervals. Accidents, pollution, and cleanup and replacement costs may be reduced as glass and mercury may be eliminated from lamp designs. Disposal cost savings may be particularly acute where used lamps must be designated and disposed of as "radioactive waste," such as, by way of non-limiting example, when such lamps have been exposed to gamma radiation in nuclear environments.

The foregoing and other aspects, features, and advantages will be apparent to those of ordinary skill in the art from the DESCRIPTION and DRAWINGS, and from the CLAIMS.

BRIEF DESCRIPTION OF THE DRAWINGS

The invention will hereinafter be described in conjunction with the appended drawings, where like designations denote like elements, and.

DETAILED DESCRIPTION

This document features a submersible high illumination light emitting diode (LED) light source. There are many features of a submersible high illumination LED light source disclosed herein, of which one, a plurality, or all features may be used in any particular implementation.

Structure/Components

Figure 1:
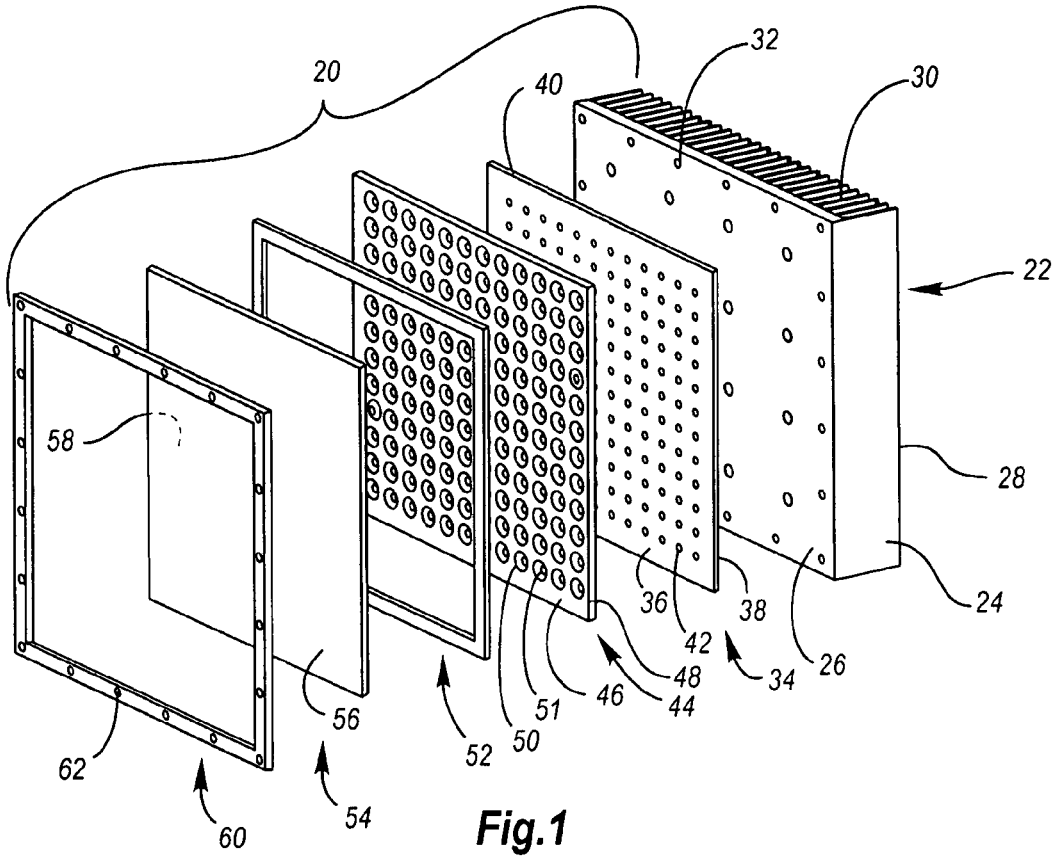
FIG. 1 is an exploded perspective view of a first particular implementation of a submersible high illumination LED light source.

There are a variety of submersible high illumination LED light source implementations. Notwithstanding, with reference to FIGS. 1 and 2, a first particular implementation of a submersible high illumination LED light source is illustrated. In particular, FIG. 1 illustrates an exploded perspective view of a submersible high illumination LED light source. In the particular implementation shown, a submersible high illumination LED light source comprises at least one module 20. Module 20 comprises heat sink 22, printed circuit board 34, a plurality of high-intensity LED lamps 42, reflector 44, window 54, gasket 52, and sealing frame 60.

By way of explanation, in the particular implementation shown, heat sink 22 (and any of the particular implementations of heat sink described herein) comprises heat sink body 24, front surface 26, rear surface 28 (which comprises a plurality of fins 30), and a plurality of mounting holes 32 disposed on front surface 26. Since module 20 is intended to operate both in in-air and underwater environments (and is intended to operate while being moved between underwater and in-air environments), it is important that heat sink 22 be constructed from a material not only having sufficient thermal properties to justify its use as an efficient heat sink, but also from a material that is corrosion resistant. The term "underwater" is intended to encompass any environment, either naturally occurring such as an ocean or man-made such as a nuclear reactor spent fuel pool, that is submerged in water or any other liquid such as, by way of non-limiting example, boric acid solution. It will be further understood that the term "submerge" encompasses those instances where a module, modular unit, device, or other component is actively moved into a position so as to be covered with water, as well as those instances where a module, modular unit, device, or other component remains stationary and a water level changes to the point of submerging a unit (such as where a module, modular unit, device, or other component is in a tank and the tank is then filled with water or other liquid solution). Conversely, removing a module, modular unit, device, or other component from submersion may comprise actively moving the module, modular unit, device, or other component from underwater, as well as those instances where a module, modular unit, device, or other component remains stationary and a water level is drained to the point of removing a module, modular unit, device, or other component from submersion (such as where a module, modular unit, device, or other component is first in a tank that is filled and then the tank is then drained).

There exist many examples of underwater work environments that require illumination. Nuclear reactor facilities are one non-limiting example of an underwater work environment. Nuclear reactor spent fuel rod pools are one such example of an underwater work environment that may be encountered at a nuclear reactor facility. Significantly, nuclear reactor spent fuel rod pools may frequently utilize a boric acid solution in which to submerge and store spent fuel rods. The boric acid may cause corrosion of devices and components that are placed therein. Accordingly, when a submersible high illumination LED light source is used in an environment such as a nuclear reactor spent fuel pool (or other corrosive underwater environment such as, by way of non-limiting example, oceanographic environments), the components of a submersible high illumination LED light source, including heat sink 22, must be corrosion resistant. Whether a submersible high illumination LED light source is operated in a nuclear reactor spent fuel pool, or another underwater environment, such as in an oceanographic application, or is operated between an underwater environment and an in-air environment, corrosion resistance is an important consideration with respect to the safe, continuous operation of a submersible high illumination LED light source.

Heat sink 22 (and any of the particular implementations of heat sink disclosed herein) may be extruded from, by way of non-limiting example, pure aluminum, 1100 aluminum, or any aluminum alloy having no copper content. In other particular implementations, heat sink 22 may be milled. While implementations using aluminum and aluminum alloys are disclosed, those having ordinary skill in the art will be able to readily identify and select other metals and/or materials having appropriate thermal properties for use as an efficient heat sink while being corrosion resistant in an underwater environment. With respect to any of the implementations disclosed herein, two or more heat sinks 22 may be coupled together or integrally joined to operate in thermal communication. Coupling one or more heat sinks 22 together to function as a single heat sink may comprise welding, bolting, or jointing two or more heat sinks together.

Rear surface 28 of heat sink 22 comprises a plurality of fins 30 arranged with sufficient space between neighboring fins 30 such that air and/or liquid may pass between neighboring fins. In some particular implementations, one or more fins 30 may be arranged vertically or near-vertically and may be spaced and pitched so that the "chimney" effect between neighboring fins is optimized (particularly when the unit is operated in-air). In particular, applicants have discovered that the plurality of fins 30 provide appropriate thermal absorption and dissipation efficiency, both where submersible high illumination LED light source module 20 is in-air and where module 20 is submerged in an underwater environment. Achieving efficient heat transfer through a heat sink is significant in maintaining the longevity and continuous operation of submersible light assembly module 20, as well as any of the particular implementations of submersible high illumination LED light source disclosed herein. In particular implementations, a heat sensor 41 may be provided. Heat sensor 41 may be wave-soldered into position on printed circuit board 34, along with the plurality of high-intensity LED lamps 42.

In those particular implementations having heat sensor 41, heat sensor 41 is capable of providing a temperature signal in response to a sensed temperature. In particular implementations, heat sensor 41 may be in communication with a power supply unit (not shown), wherein the power supply unit powers down submersible high illumination LED light source module 20 (or any other implementations of submersible high illumination LED light source disclosed herein such as, by way of non-limiting example, modular unit 64) should heat sensor 41 detect a critical heat buildup. A pre-determined level of critical heat buildup may be established, such that when heat sensor 41 provides a temperature signal in response to a sensed temperature, a safety switch or other device known in the art, in conjunction with a control unit, causes the power supply unit to power down. In some particular implementations, a power control unit may comprise separate power sources for underwater operation and in-air operation of a submersible high illumination light source. In other particular implementations, a power control unit may provide direct current to a submersible high power light source assembly. In those implementations providing direct current to a submersible high power light source assembly, a voltage rectifier or inverter capable of converting alternating current (AC) provided from a power supply to direct current (DC) for use by a submersible high power light source assembly. Also, in those particular implementations using direct current, a low-voltage direct current such as, by way of non-limiting example, about 40 volts and between about 5 amperes to about 12 amperes may be used. It will be understood that, in other particular implementations, different voltages, amperages, and wattages may be used.

In any event, should excess heat accumulate in submersible high illumination LED light source module 20 (or other implementation of submersible high illumination LED light source disclosed herein), the longevity of the a plurality of high-intensity LED lamps 42 may be significantly diminished, thereby possibly undesirably increasing the amount of down-time for a unit, increasing the overall cost of lamp replacement over the life of a unit, and requiring more frequent maintenance of a submersible high illumination LED light source. It will be appreciated that reducing the frequency of required maintenance is particularly useful in nuclear environments, where workers may be exposed to radiation and potential personal radioactive contamination each time a lamp replacement is required.

Front surface 26 of heat sink 22 is in thermal contact with printed circuit board 34 such that heat sink 22 absorbs (and dissipates) waste heat from printed circuit board 34 (particularly the plurality of high-intensity LED lamps 42). In some particular implementations of a submersible high illumination LED light source, a thermal paste 98 (FIG. 10) may be provided between heat sink 22 (and/or any other heat sink described herein) and printed circuit board 34 (and/or any other printed circuit board described herein). In some particular implementations, thermal paste 98 may comprise Wakefield® 120 blend of thermal paste, although any thermal paste having good thermal conductivity such that printed circuit board 34 makes good thermal contact with heat sink 22 may be used. In any event, printed circuit board 34 (and other examples of printed circuit board described herein) comprises trace layer 36 and base layer 38. In particular implementations, base layer 38 comprises an electrically conductive base layer separated from trace layer 36 (which may comprise a plurality of electrically conductive traces) by dielectric layer 40. In other particular implementations, base layer 38 and trace layer 36 are made from materials having no copper content. Notwithstanding, printed circuit board 34 is in contact with front surface 26 of heat sink 22 such that waste heat generated via printed circuit board 34 (particularly heat generated via the plurality of high-intensity LED lamps 42 that are in electrical communication trace layer 36), is absorbed by heat sink 22 via front surface 26. Once absorbed by heat sink 22, waste heat may be dissipated via heat sink body 24 and via at least one fin 30. It will be understood that to optimize the longevity of submersible high illumination LED light source module 20 (and other particular implementations of submersible high illumination LED light sources disclosed herein), efficient heat dissipation via one or more fins 30 should occur while module 20 is operated both in-air and underwater, and between in-air and underwater environments.

Figure 2:
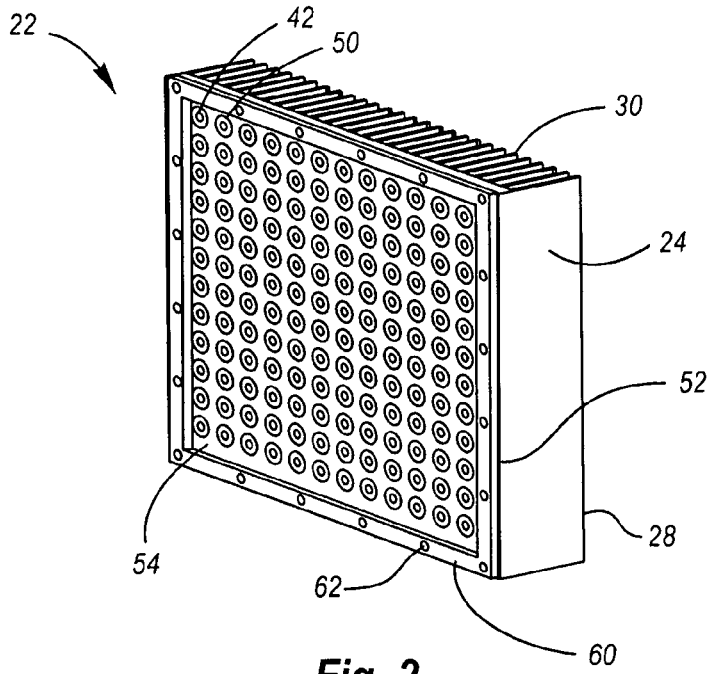
FIG. 2 is an assembled perspective view of the implementation of FIG. 1.
Figure 3:
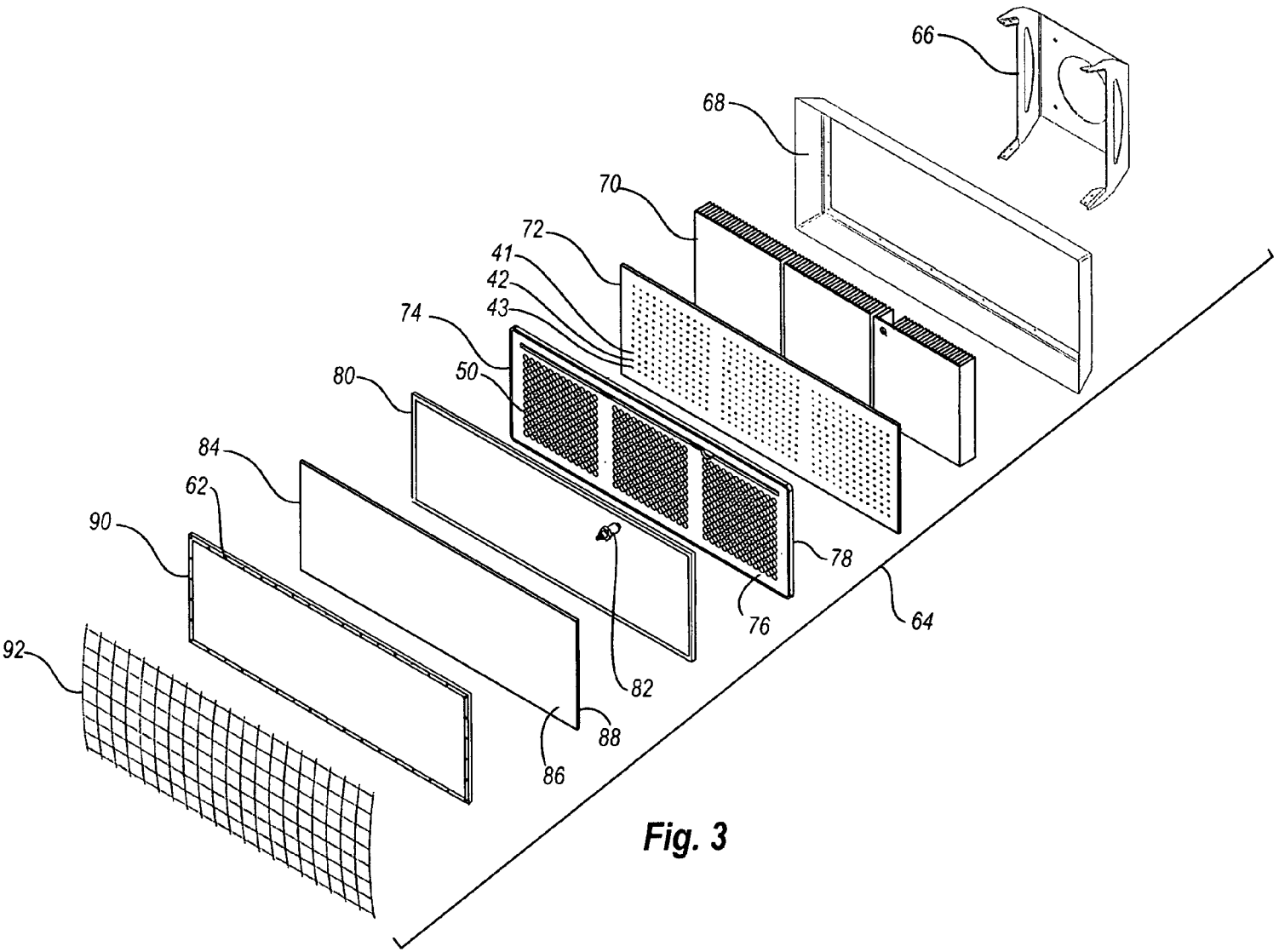
FIG. 3 is an exploded perspective view of a second particular implementation of a submersible high illumination LED light source.

Still referring to FIG. 1, in the particular implementation shown, printed circuit board 34, heat sink 22, and submersible high illumination LED light source module 20 each comprise dimensions of approximately 1 square foot. In the particular implementation shown, module 20 comprises an array of 144 high-intensity LED lamps 42. Notwithstanding, in other particular implementations, either greater or fewer than 144 high-intensity LED lamps 42 may be provided (and may be arranged in any particular pattern with respect to printed circuit board 34). In some particular implementations, two or more modules 20 may be coupled together or integrally joined to form a modular unit 64 (FIGS. 3-9). In those implementations where two or more modules have been coupled together or integrally joined together, the components defining a single module 20 may themselves be coupled together or integrally joined together. For the exemplary purposes of this disclosure, single-module submersible high illumination LED light source module 20 implementations are shown in FIGS. 1 and 2. These single-module submersible high illumination LED light source implementations house all of the components required for a submersible high illumination LED light source. Notwithstanding, it is anticipated that one or more modules 20 may be joined together in electronic communication (via one or more appropriate electrical connectors 43) to be operated in conjunction, thereby creating a modular system. Therefore, a modular unit 64 may include as many submersible high illumination LED light source modules 20 as required, and configured as necessary, according to the lighting requirements of a particular application and the needs of a particular user. Specifically, two or more submersible high illumination LED light source modules 20 may be either arranged adjacently or coupled adjacently with respect to one another in order to form a modular unit 64 (FIGS. 3-9).

Referring to printed circuit board 34, the plurality of high-intensity LED lamps 42 may be directly coupled in electrical communication with trace layer 36. In particular implementations, the plurality of high-intensity LED lamps 42 may be soldered such as, by way of non-limiting example, wave-soldered to trace layer 36. Additional components, such as heat sensor 41 (described above) and electrical connector 43 may be wave-soldered to printed circuit board 34 (or any other printed circuit board described herein) at the same time as the plurality of high-intensity LED lamps 42 are wave soldered to printed circuit board 34. Electrical connector 43 may comprise any electrical connector configurable to appropriately connect and/or interconnect in electronic communication a plurality high-intensity LED lamps 42, one or more printed circuit boards 34, and/or other components, with a power supply. In some particular implementations, one or more electrical connector 43 may comprise Molex® brand electrical connectors. From this disclosure, those having ordinary skill in the art will be able to select appropriate electrical connectors. In any event, the plurality of high-intensity LED lamps 42 may comprise any high-intensity LED lamp such as, by way of non-limiting example, a Cree® XLamp XR-E model LED. While 1-watt LED lamps are disclosed, it will be understood that any wattage LED lamp consistent with the disclosures of this document may be used. In some particular implementations, the plurality of high-intensity LED lamps 42 may comprise a wattage of about 1 watt to about 5 watts.

In some particular implementations, with a plurality of high-intensity LED lamps 42 in electrical communication with trace layer 36, the plurality of high-intensity LED lamps 42 may be encapsulated with a conformance coating 102 (FIG. 11) such that each of the plurality of high-intensity LED lamps 42 are redundantly encapsulated in the event of a breach of gasket 52 and/or window 54 (or any other breach of any module, modular unit, component thereof, or cooperation of components thereof, as described herein). Conformance coating 102 may comprise any coating or film sufficient to serve as a redundant water barrier. In some particular implementations, conformance coating 102 may comprise an epoxy coating. In other particular implementations, conformance coating 102 may comprise a plastic film.

Still referring to FIG. 1, reflector 44 overlays printed circuit board 34 and is in communication with heat sink 22. In the particular implementation shown, reflector 44 comprises a reflector plate having a front surface 46 and a rear surface 48, the front and rear surfaces in communication via a plurality of dimples 50, each dimple 50 sized and shaped to accept the insertion therein of at least one of the plurality of high-intensity LED lamps 42. In some particular implementations, each of a plurality of dimples 50 may comprise a hole 51 therethrough such that at least a portion of one or more of the plurality of high-intensity LED lamps 42 pass through the hole 51 when reflector 44 is fitted over printed circuit board 34. In other particular implementations, each of a plurality of dimples 50 may comprise an enclosed transparent portion such as a transparent cover or lens over hole 51. In still other particular implementations, reflector 44 may comprise a focused reflector portion associated with one or more of the plurality of dimples 50, the focused reflector configured to reflect light emitted from the plurality of high-intensity LED lamps 42 from an angle of about 90° (with respect to reflector 44) to an angle up to about 180° (with respect to reflector 44). In yet other implementations, such as that shown with respect to FIG. 11, reflector 44 may comprise a plurality of individual reflectors 100, the plurality of individual reflectors 100 each coupled directly with an associated lamp 42 of the plurality of high-intensity LED lamps 42. In those particular implementations having a plurality of individual reflectors 100, individual reflector may comprise Fraen® brand FRC-N1-XR79-0R-Model Reflector which, in particular implementations, may snap fit directly to individual high-intensity LED lamps 42. In other particular implementations, the plurality of individual reflectors 100 may comprise conical reflectors comprising a narrow (about a 1°-10° beam angle), medium (about 11°-40° beam angle) or wide (about a 41°-180° beam angle) beam dispersion. Notwithstanding, any reflector arrangement consistent with the disclosures contained herein may be used.

With the plurality of high-intensity LED lamps 42 coupled in electrical communication with printed circuit board 34, and with printed circuit board 34 in thermal communication with heat sink 22, reflector 44 may be positioned over printed circuit board 34 such that the plurality of high-intensity LED lamps 42 are each nested within one of the plurality of dimples 50 (or, within one of the plurality of individual reflectors 100, in those particular implementations where reflector 44 comprises a plurality of individual reflectors 100). With reflector 44 arranged in the foregoing manner, reflector 44 may thereafter be removably coupled with heat sink 22 via adhesive, one or more fasteners, or any other suitable manner known in the art. A watertight gasket may be interposed between a perimeter edge of reflector 44 and heat sink 22 (or between any other components described herein, as may be required by the needs of a particular application), in order to provide or assist in providing a watertight seal.

Window 54 is placed over reflector 44 and, in conjunction with gasket 52 and sealing frame 60, provides a watertight barrier between an underwater environment (not shown) and reflector 44. In some particular implementations, rear surface 58 of window 54 and/or front surface 46 of reflector 44 may comprise a groove or channel around their respective perimeters in which gasket 52 may reside. Gasket 52 (or any other gasket described herein) may comprise any silicone, polyurethane or similar gasket. In particular, gasket 52 is positioned about a perimeter of reflector 44 and window 54 is placed over the situated gasket 52. Once gasket 52 and window 54 are in position, a user may thereafter position sealing frame 60 over window 54 and thereafter couple sealing frame 60 with heat sink 22. To couple sealing frame 60 with heat sink 22, a user may first align the plurality of mounting holes 62 on sealing frame 60 with the plurality of mounting holes 32 on heat sink 22. With the plurality of mounting holes 62 on sealing frame 60 aligned with the plurality of mounting holes 32 on heat sink 22, a user may thereafter fasten sealing frame 60 to heat sink 22 with one or more fasteners inserted and fastened through mounting holes 62 and mounting holes 32. With sealing frame 60 coupled with heat sink 22 in the foregoing manner, the module is "sealed" (via at least the compression of gasket 52 between window 54 and reflector 44), and may be watertight for pressures up to about 2 bars.

The implementations of sealed module 20 that have been described above at least receive power from an external power supply, in addition to other possible external electronic power supplies and communications made possible by and consistent with the disclosures contained herein. Accordingly, since sealed module 20 is designed to operate both in-air and in underwater environments, the electrical connection between module 20 and/or its individual components such as, by way of non-limiting example, one or more electrical connectors 43, and its power supply and/or other external components, must be watertight. Accordingly, underwater electrical connector 82 (shown in FIG. 3, but which may be provided with respect to any of the particular implementations of module 20, modular unit 64, or any other particular implementation of submersible high illumination LED light source described herein) is provided in order to allow waterproof electrical communication between module 20 (or any components thereof) and a power source or other external component. Specifically, watertight electrical connector 82 provides watertight electronic communication between module 20 and external components that may be provided in particular implementations. While waterproof electrical connector 82 has been illustrated as passing through rear surface 28 of heat sink 22, it is not required that waterproof electrical connector 82 pass therethrough. Specifically, waterproof electrical connector 82 may be placed anywhere on the outside of any component defining module 20 (and/or modular unit 64, described below) as long as waterproof electrical connector 82 provides a watertight electrical connection between sealed module 20, and an external component (such as a power supply).

In addition to the foregoing, in some particular implementations, sealing frame 60 (or any other sealing frame disclosed herein) may be coupled with heat sink 22 in other ways such as by way of non-limiting example, adhesives, clamps, or the like. Accordingly, window 54 (or any other particular implementation of window described herein) may be coupled in watertight communication with reflector 44 (or any other particular implementation of reflector described herein) in a variety of ways such as, by way of non-limiting example, adhesives, screw fasteners and/or the like. In any event, window 54 (and/or any other window described herein) may comprise any type of glass such as, by way of non-limiting example, quartz glass or tempered glass. In some particular implementations, window 54 may be required to withstand ambient pressures of about two (2) bars, thus requiring an appropriate thickness and structural quality of material that can safely withstand such pressures in a safety-critical application.

Referring now to FIG. 2, this figure illustrates an assembled perspective view of submersible high illumination LED light source module 20. As can be seen from a comparison of FIG. 1 to FIG. 2, FIG. 2 is assembled so that the module 20 is sealed. As noted above, two or more modules 20 (or components thereof) may be coupled together or integrally joined to form a modular unit (such as modular unit 64).

FIGS. 3-9 illustrate a second particular implementation of submersible high illumination LED light source. In particular FIGS. 3-9 illustrate submersible high illumination LED light source modular unit 64 ("modular unit 64"). As described more fully below, two or more assembled modules 20 (according to the first particular implementation) may be coupled together or integrally joined to form modular units such as, by way of non-limiting example, modular unit 64. In addition, as described more fully below, individual components defining module 20 may be coupled together or integrally joined to form modular components (such as, by way of non-limiting example, joining together three heat sinks 22 from a first particular implementation to form a heat sink 70, according to a second particular implementation). Modular components may thereafter be assembled to form a modular unit. Accordingly, a modular unit (including exemplary modular unit 64) may be constructed from modular components (such as the individual components from module 20 joined together to form modular components), or may be formed by using multiple individual components from module 20. While the implementations of modular unit 64 that follow illustrate three-module (triple-module) implementations, it will be understood that implementations of modular units may include any number of modules 20 including, by way of non-limiting example, single-module units, double-module units, triple-module units, etc.

Modular unit 64 comprises mounting bracket 66, shroud 68, heat sink 70, printed circuit board 72 (with which may be coupled a plurality of high-intensity LED lamps 42, one or more heat sensors 41, and one or more electrical connectors 43), reflector 74, gasket 80, underwater electrical connector 82, window 84, sealing frame 90, and grate 92. As noted above, heat sink 70, printed circuit board 72, reflector 74, gasket 80, window 84, and sealing frame 90 may, in particular implementations, comprise modular components (components formed by the coupling or integral joining of the individual components defining module 20), or by the simple duplication individual components from module 20. For example, in some particular implementations, printed circuit board 72 may comprise three previously-individual printed circuit boards 34 according to the first particular implementation that are operably coupled with one another and/or with their own power supply controls (via one or more electrical connectors 43), to form a single modular printed circuit board. By way of further non-limiting example, printed circuit board 70 may comprise a single printed circuit board. Alternatively, modular unit 64 may comprise three individual printed circuit boards 34 in electronic communication via a series or parallel connection to form printed circuit board 70.

Still referring to FIGS. 3-9, in some particular implementations of modular unit 64, a modular unit 64 may comprise an array 94 (comprising sub-arrays 94*a*, 94*b*, and 94*c*) of three individual modules 20. While the implementations of modular unit 64 that follow illustrate a three-module implementation, it will be understood that implementations of modular units may include any number of modules 20 including, by way of non-limiting example, single-module units, double-module units, triple-module units, etc. Therefore, it is specifically contemplated that one or more modules 20 may be operated in conjunction with one another, thereby creating a modular unit 64 that may include as many submersible light assembly modules 20 as required, and configured as necessary, according to the lighting requirements of a particular application. The particular requirements of an application may vary based upon, among other things, the amount of illumination required and/or desired for a particular application, the available volume and shape within which to place one or more modules 20, the type and amount of current available at a particular location, the particular intensity and/or wattage of the high-intensity LED lamps 42 used, and/or other considerations. Notwithstanding, while modular unit 64 may be constructed by the coupling or integral joining of two or more modules 20 (or components thereof), modular unit 64 may likewise be constructed with its own unique components described herein, or by the duplication of components defining module 20.

In any event, the plurality of high-intensity LED lamps 42 are operably coupled in electronic communication with printed circuit board 72 (which, as noted above, may comprise a single-board design, or may comprise a modular design such as, by way of non-limiting example, comprising two or more printed circuit boards 34). In addition, one or more heat sensors 41 and one or more electrical connectors 43 are likewise operably coupled with printed circuit board 72. As noted above with respect to FIGS. 1 and 2, the plurality of high-intensity LED lamps 42, the one or more heat sensors 41, and the one or more electrical connectors 43 may be simultaneously wave-soldered to printed circuit board 72 in a single manufacturing operation. With the plurality of high-intensity LED lamps 42, one or more heat sensors 41, and one or more electrical connectors 43 operably coupled with printed circuit board 72, a rear surface of printed circuit board 72 may be coupled with a front surface of heat sink 70. In some particular implementations, a thermal paste 98 may be introduced between heat sink 70 and printed circuit board 72, before the parts are joined. With heat sink 70 and printed circuit board 72 in thermal communication, a user may thereafter overlay reflector 74 over printed circuit board 72.

In the particular implementation shown, reflector 74 comprises a reflector plate having a front surface and a rear surface, the front and rear surfaces in communication via a plurality of dimples 50, each dimple 50 sized and shaped to accept the insertion therein of at least one of the plurality of high-intensity LED lamps 42. In some particular implementations, each of a plurality of dimples 50 may comprise a hole 51 therethrough such that at least a portion of one or more of the plurality of high-intensity LED lamps 42 pass through the hole 51 when reflector 74 is fitted over printed circuit board 34. In other particular implementations, each of a plurality of dimples 50 may comprise an enclosed transparent portion such as a transparent cover or lens over hole 51. In still other particular implementations, reflector 74 may comprise a focused reflector portion associated with one or more of the plurality of dimples 50, the focused reflector configured to reflect light emitted from the plurality of high-intensity LED lamps 42 from an angle of about 90° (with respect to reflector 74) to an angle up to about 180° (with respect to reflector 74).

Figure 11:
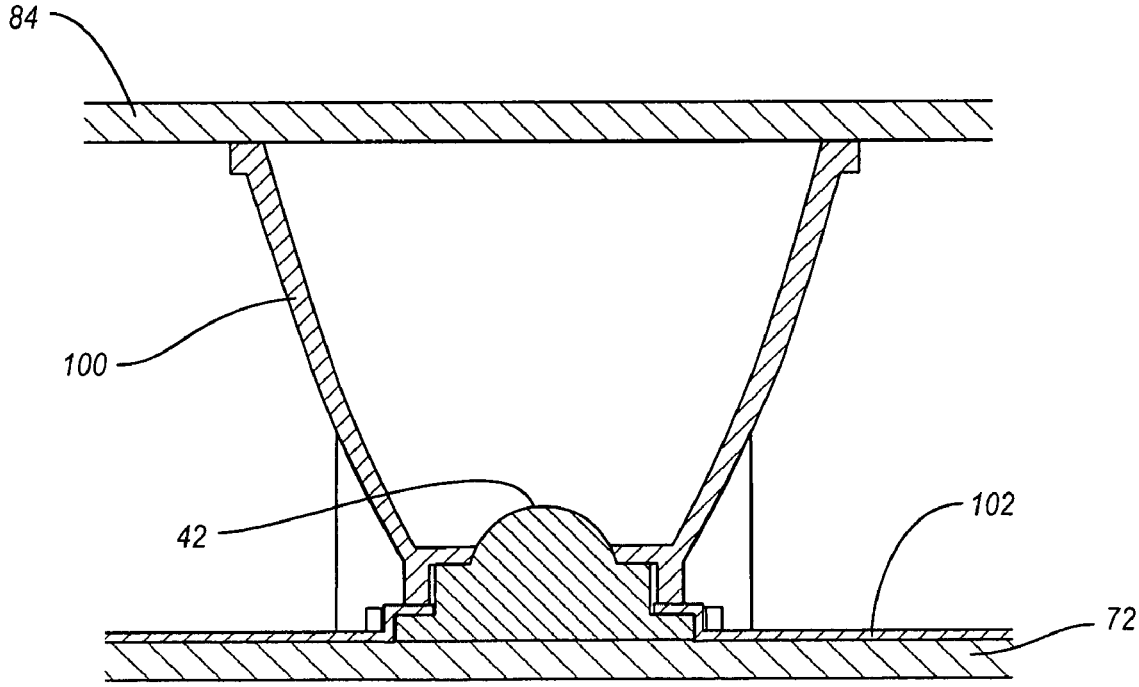
FIG. 11 is a portion of a view of a fourth particular implementation of a submersible high illumination LED light source enlarged for magnification purposes.

In yet other implementations, such as that shown with respect to FIG. 11 (shown as an alternative embodiment taken from detail 11 of FIG. 9), reflector 74 may comprise a plurality of individual reflectors 100, the plurality of individual reflectors 100 each coupled directly with an individual lamp 42 of the plurality of high-intensity LED lamps 42. In those particular implementations having a plurality of individual reflectors 100, window 84 (or any other window disclosed herein) may be installed such that an inner surface of the window (such as inner surface 88 of window 84) is in contact with, and supported by the plurality of individual reflectors 100. In addition, in this arrangement, window 84 (or any other window disclosed herein) is in mechanical cooperation with the plurality of individual reflectors 100 such that the plurality of individual reflectors 100 are further maintained in position with respect to the plurality of high-intensity LED lamps 42 through the contact of window 84 (or any other window disclosed herein) with the plurality of individual reflectors 100.

Still referring to FIGS. 3-9, window 84 is placed over reflector 74 and, in conjunction with gasket 80 and sealing frame 90, provides a watertight barrier between an underwater environment (not shown) and reflector 74. In some particular implementations, window 84 and/or reflector 74 may comprise a groove or channel around their respective perimeters in which gasket 80 may reside. Gasket 80 (or any other gasket described herein) may comprise any silicone, polyurethane or similar gasket. In particular, gasket 80 is positioned about a perimeter of reflector 74 and window 84 is placed over the situated gasket 80. Once gasket 80 and window 84 are in position, a user may thereafter position sealing frame 90 over window 84 and thereafter couple sealing frame 90 with heat sink 70. To couple sealing frame 90 with heat sink 70, a user may first align the plurality of mounting holes 62 on sealing frame 90 with the plurality of mounting holes 32 on heat sink 70. With the plurality of mounting holes 62 on sealing frame 90 aligned with the plurality of mounting holes 32 on heat sink 70, a user may thereafter fasten sealing frame 90 to heat sink 70 with one or more fasteners inserted and fastened through mounting holes 62 and mounting holes 32. With sealing frame 90 coupled with heat sink 70 in the foregoing manner, the module is "sealed" (via at least the compression of gasket 80 between window 84 and reflector 74), and is watertight for pressures up to about 2 bars.

In other particular implementations, sealing frame 90 may be coupled with heat sink 70 in other manners such as by way of non-limiting example, adhesives, clamps, or the like. Accordingly, window 84 may be coupled in watertight communication with reflector 74 in a variety of ways such as, by way of non-limiting example, adhesives, screw fasteners and/or the like. In any event, window 84 (and any other window described herein) may comprise any type of glass such as, by way of non-limiting example, quartz glass or tempered glass. In some particular implementations, window 84 may be required to withstand ambient pressures of about two (2) bars, thus requiring an appropriate thickness and structural quality of material that can safely withstand such pressures in a safety-critical application.

Figure 4:
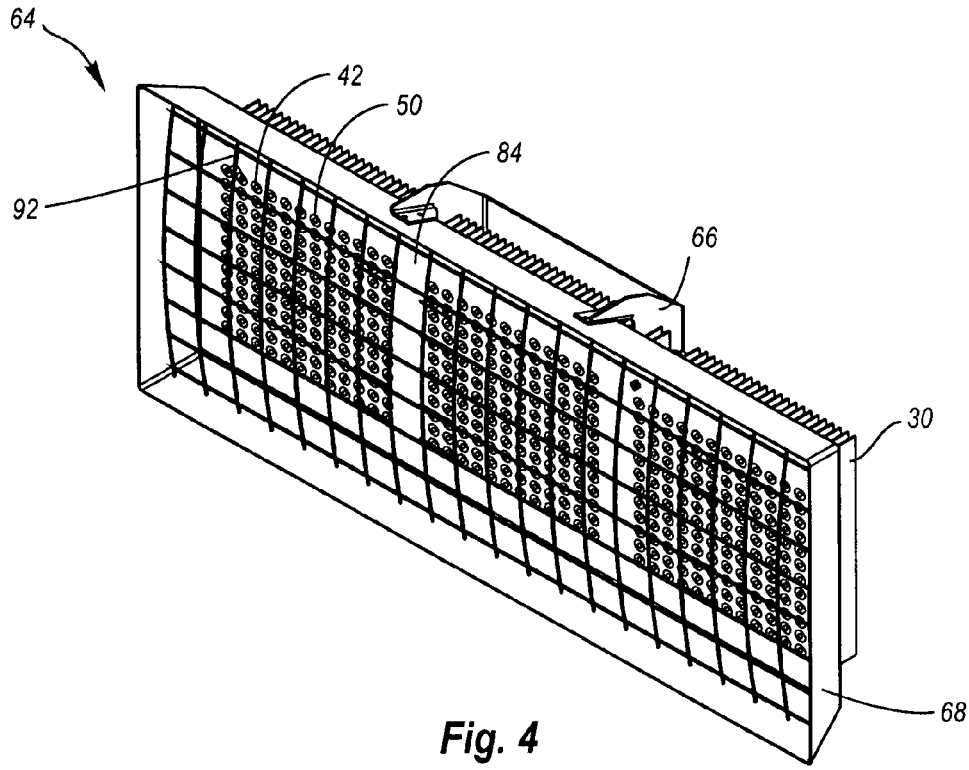
FIG. 4 is a perspective assembled view of the implementation of FIG. 3.
Figure 5:
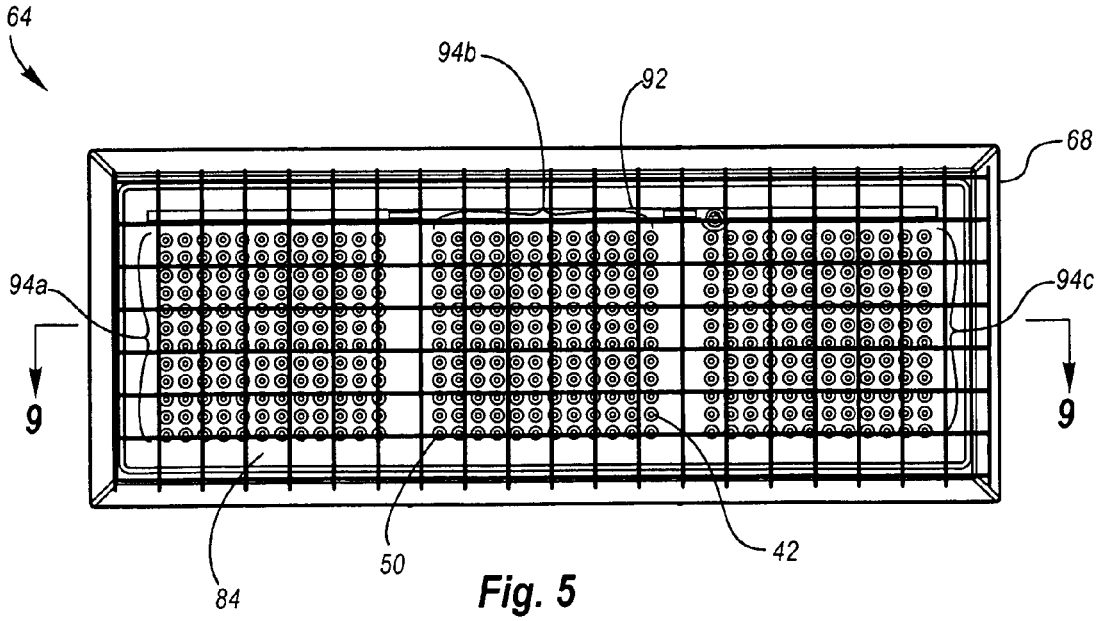
FIG. 5 is a front view of the implementation of FIG. 3.
Figure 6:
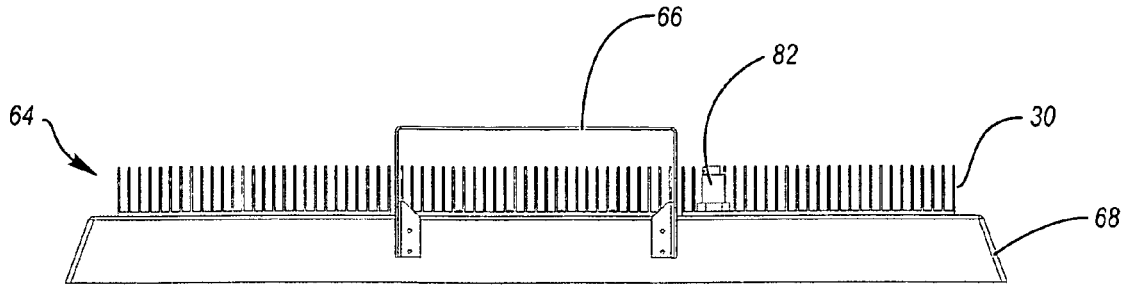
FIG. 6 is a top view of the implementation of FIG. 3.
Figure 7:
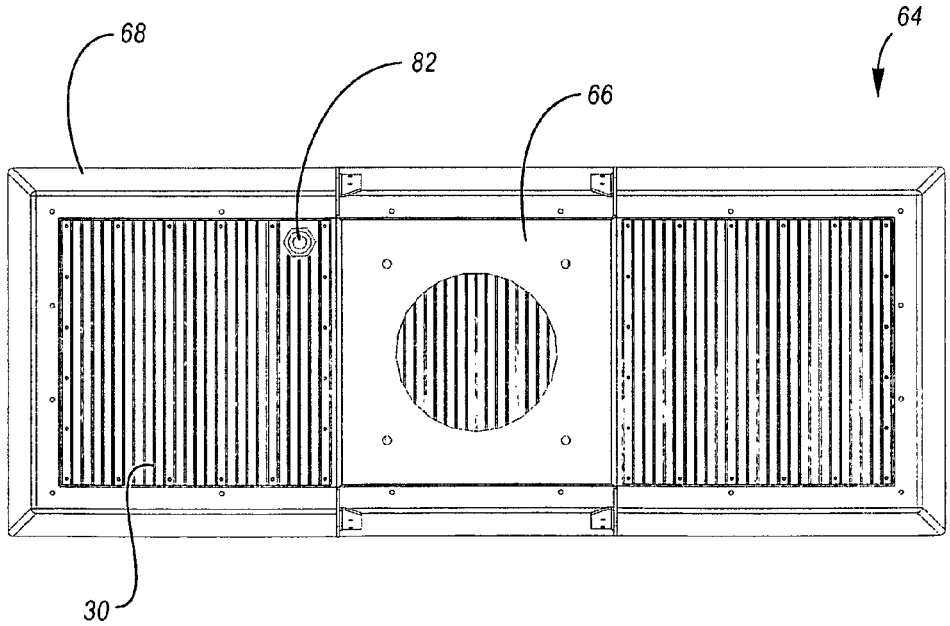
FIG. 7 is a rear view of the implementation of FIG. 3.
Figure 8:
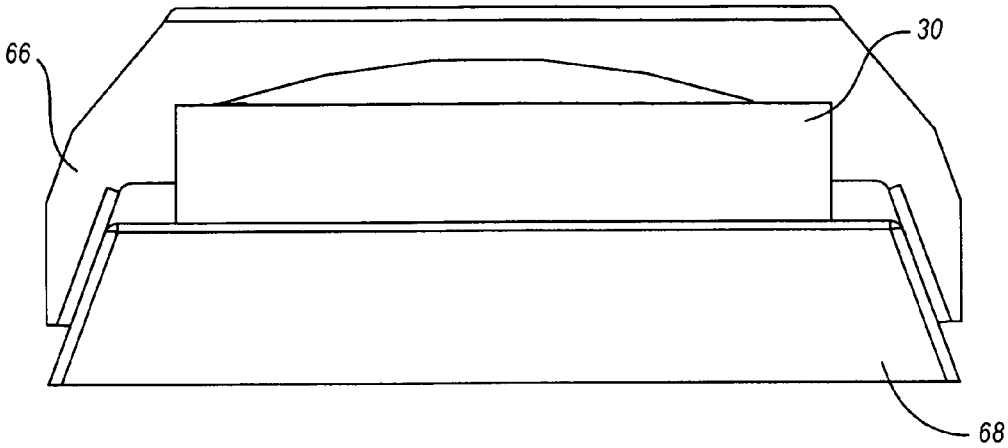
FIG. 8 is an end view of the implementation of FIG. 3.
Figure 9:
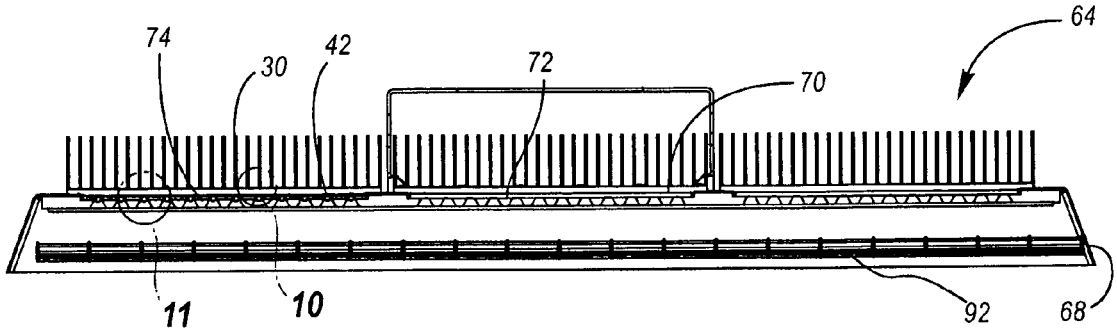
FIG. 9 is a cross-sectional view of the implementation of FIG. 3, taken along cross-sectional line 9-9 of FIG. 7.

With modular unit 64 sealed, a user may thereafter couple the unit with shroud 68 and mounting bracket 66. Shroud 68 and mounting bracket 66 may each be constructed from aluminum or stainless steel (or other appropriate material) having no copper content. In addition, grate 92 (which may also be constructed from aluminum or stainless steel having no copper content) may be provided within shroud 68 in order to resist contact of foreign objects with window 84, as illustrated in FIGS. 4 and 5.

Figure 10:
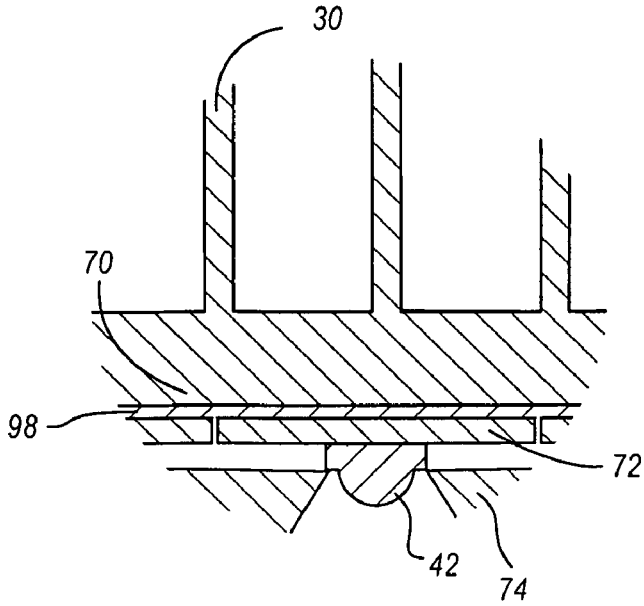
FIG. 10 is a portion of a view of a third particular implementation of a submersible high illumination LED light source enlarged for magnification purposes.

Turning now to FIG. 10, this figure illustrates a portion of a view (detail 10 from FIG. 9) of a third particular implementation of a submersible high illumination LED light source enlarged for magnification purposes. As illustrated, a thermal paste 98 may be provided between heat sink 70 and printed circuit board 72. As noted above, a thermal paste 98 may have good thermal conductivity such that printed circuit board 72 makes good thermal contact with heat sink 70.

Referring now to FIG. 11, this figure illustrates a portion of a view (detail 11 from FIG. 9) of a fourth particular implementation of a submersible high illumination LED light source enlarged for magnification purposes. As noted above, reflector 74 (or any other reflector disclosed herein) may comprise a plurality of individual reflectors 100, and the plurality of individual reflectors 100 may each be coupled directly with an individual lamp 42 of the plurality of high-intensity LED lamps 42 (or may be secured in any other suitable arrangement). In those particular implementations having a plurality of individual reflectors 100, window 84 (or any other window disclosed herein) may be installed such that an inner surface of the window (such as inner surface 88 of window 84) is in contact with, and supported by the plurality of individual reflectors 100. In addition, in this arrangement, window 84 (or any other window disclosed herein) is in mechanical cooperation with the plurality of individual reflectors 100 such that the plurality of individual reflectors 100 are further maintained in position with respect to the plurality of high-intensity LED lamps 42 through the contact of window 84 (or any other window disclosed herein) with the plurality of individual reflectors 100. Notwithstanding, any reflector consistent with the disclosures contained herein may be used.

Other Implementations

Many additional submersible high illumination light source assembly implementations are possible.

For the exemplary purposes of this disclosure, in some implementations, conformance coating 102 may not be provided. In other particular implementations, one or more unit bases, power cables, transformers, inverters, power control units, universal power supplies, touch screens, in-air power sources, underwater power supplies, extendable booms, positionable adjustment mechanisms, and implementing components may be provided.

For the exemplary purposes of this disclosure, in some implementations, one or more watertight gaskets may be provided between any of the components defining module 20, modular unit 64, and/or any other implementation of submersible high illumination light source described herein. In such implementations, by way of non-limiting example, reflector 44 (and/or reflector 74) may be coupled with a heat sink 22 (and/or heat sink 70) via a watertight gasket. In addition, window 54 and/or 84 may be coupled with reflector 44 and/or reflector 74, respectively, via a watertight gasket.

For the exemplary purposes of this disclosure, a module 20 and/or a modular unit 64 may adjust telescopically with respect to one or more positionable bases. For example, a submersible light assembly module 20 may adjust with respect to a base from about less than 0.25" to about 120'. For the further exemplary purposes of this disclosure, some implementations may also include mounting bracket 66 (FIGS. 3-9) for removably coupling one or more modules 20 and/or modular units 64 with a base.

Further implementations are within the CLAIMS.

Specifications, Materials, Manufacture, Assembly, and Installation

It will be understood that submersible light assembly implementations are not limited to the specific assemblies, devices and components disclosed in this document, as virtually any assemblies, devices and components consistent with the intended operation of a submersible light assembly implementation may be utilized. Accordingly, for example, although particular heat sinks, fins, printed circuit boards, high-intensity LED lamps, heat sensors, electrical connectors, inverters, rectifiers, conformance coatings, reflectors, individual reflectors, windows, gaskets, sealing frames, modules, modular units, bases, power cables, transformers, power control units, universal power sources, in-air power sources, underwater power sources, extendable booms, positionable adjustment mechanisms, and other assemblies, devices and components are disclosed, such may comprise any shape, size, style, type, model, version, class, measurement, concentration, material, weight, quantity, and/or the like consistent with the intended operation of a submersible light assembly implementation. Implementations are not limited to uses of any specific assemblies, devices and components; provided that the assemblies, devices and components selected are consistent with the intended operation of a submersible light assembly implementation.

Implementations of submersible light assemblies and implementing components may be constructed of a wide variety of materials. For example, the components may be formed of: polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; glasses (such as quartz glass), carbon-fiber, aramid-fiber, any combination thereof, and/or other like materials; composites and/or other like materials; metals, such as zinc, magnesium, titanium, copper, lead, iron, steel, carbon steel, alloy steel, tool steel, stainless steel, brass, tin, antimony, pure aluminum, 1100 aluminum, aluminum alloy, any combination thereof, and/or other like materials; alloys, such as aluminum alloy, titanium alloy, magnesium alloy, copper alloy, any combination thereof, and/or other like materials; any other suitable material; and/or any combination of the foregoing thereof. For the exemplary purposes of this disclosure, a printed circuit board may comprise one or more conductive layers laminated with a non-conductive substrate.

Some components defining module and modular unit manufacturing implementations may be manufactured simultaneously and integrally joined with one another, while other components may be purchased pre-manufactured or manufactured separately and then assembled with the integral components. Various implementations may be manufactured using conventional procedures as added to and improved upon through the procedures described here.

Accordingly, manufacture of these components separately or simultaneously may involve vacuum forming, injection molding, blow molding, casting, forging, cold rolling, milling, drilling, reaming, turning, grinding, stamping, pressing, cutting, bending, welding, soldering, hardening, riveting, punching, plating, and/or the like. Components manufactured separately may then be coupled or removably coupled with the other integral components in any manner, such as with adhesive, a weld joint, a solder joint, a fastener (e.g. a bolt and a nut, a screw, a rivet, a pin, and/or the like), washers, retainers, wrapping, wiring, any combination thereof, and/or the like for example, depending on, among other considerations, the particular material forming the components.

A non-limiting exemplary method of manufacture of a module 20 is now described. In some particular implementations, heat sink 22 (with its plurality of fins 30) is first extruded. In other particular implementations, the base 24 of heat sink 22 may be milled, and then a plurality of fins 30 may be coupled thereto. In any event, once heat sink 22 has been formed, front surface 26 may be surface-ground in order to provide a smooth surface for efficient heat transfer. With the surface grinding of front surface 26 complete, the plurality of mounting holes 32 may be machined or otherwise thread-cut. Thermal paste 98 may be applied to front surface 26 of heat sink 22, and rear surface 38 of printed circuit board 34 thereafter mated with the front surface 26 of heat sink 22. It will be understood that, prior to mating printed circuit board 34 with heat sink 22, a plurality of high-intensity LED lamps 42, one or more heat sensors 41, and one or more electrical connectors 43 may be wave-soldered or otherwise affixed to printed circuit board 34. In any event, with printed circuit board 34 coupled with heat sink 22, all electrical connectors 43 and implementing components may be assembled and/or installed.

Reflector 44 may next be placed in position with respect to printed circuit board 34 such that the plurality of high-intensity LED lamps 42 each are nestled in a respective dimple 50 of reflector 44 (in those implementations where reflector 44 comprises a reflector plate). Notwithstanding, in those particular implementations where reflector 44 comprises a plurality of individual reflectors 100, the plurality of individual reflectors 100 may each be coupled with an associated LED lamp 42 of the plurality of high-intensity LED lamps 42. With reflector 44 in position, gasket 52 may next be placed in position about a perimeter of reflector 44. With gasket 52 in position about the perimeter of reflector 44, window 54 is placed over the situated gasket 52. Once gasket 52 and window 54 are in position, a user may thereafter position sealing frame 60 over window 54 and thereafter couple sealing frame 60 with heat sink 22. Specifically, to couple sealing frame 60 with heat sink 22, a user may first align the plurality of mounting holes 62 on sealing frame 60 with the plurality of mounting holes 32 on heat sink 22. With the plurality of mounting holes 62 of sealing frame 60 aligned with the plurality of mounting holes 32 of heat sink 22, a user may thereafter fasten sealing frame 60 to heat sink 22 with one or more fasteners (not shown) inserted and fastened through mounting holes 62 and mounting holes 32. With sealing frame 60 coupled with heat sink 22 in the foregoing manner, the module 20 is "sealed." At this point, module 20 may be connected to an external power supply, or any other external component(s) that may be provided in connection with other implementations such as, by way of non-limiting example, those described in the "other implementations" section above. While an exemplary method of manufacture has been described, it will be understood that components defining module 20 and/or module 64 may be manufactured in the same process or in separate processes, and then may be assembled in any order consistent with the disclosures contained herein. Therefore, it will be understood that the exemplary method manufacture set forth above is illustrative, and not restrictive.

Use/Operation

Submersible light assembly implementations may comprise a portable, adjustable submersible light assembly rated for AC and DC and for high and low voltage. Submersible light assembly implementations may be used in a variety of places and may be moved between underwater and in-air environments while operating and without first powering down and with similar results, such as in nuclear reactor spent fuel pools, oceans, lakes, harbors, and other underwater work environments where high-intensity illumination may be required. Nevertheless, implementations are not limited to uses relating to the foregoing. Rather, any description relating to the foregoing is for the exemplary purposes of this disclosure, and implementations may also be used with similar results for a variety of other applications.

In addition to the foregoing, a module 20 and/or modular unit 64 (and/or other particular implementations of a submersible high illumination light source assembly) may be coupled with a base via one or more extendable booms, each extendable boom positionable along multiple axes (including at least horizontal and vertical axes). With an extendable boom positioned as desired, a user may thereafter secure the extendable boom in a fixed position with respect to the base via one or more positionable adjustment mechanisms.

In describing the operation of submersible high illumination light source assembly implementations further, and for the exemplary purposes of this disclosure, the operation of module 20 and/or modular unit 64 (and/or other particular implementations of a submersible high illumination light source assembly) will now be described. A power cable comprising a standard cord assembly having two or more conductors insulated from one another by one or more dielectric layers is removably or permanently coupled in electronic communication with module 20 and/or modular unit 64 (and/ or other particular implementations of a submersible high illumination light source assembly).

The power cable is connected to, and is in electronic communication with, one or more power sources. The one or more power sources may comprise a universal power source configured to power module 20 and/or modular unit 64 (and/or other particular implementations of submersible high illumination light source described herein), whether the unit is operating in-air, underwater, or partially-submerged. Likewise, the one or more power sources may comprise an in-air power source configured to power submersible light module 20 and/or modular unit 64 (and/or other particular implementations of a submersible high illumination light source assembly), when the assembly is operating in-air. In addition, the one or more power sources may comprise an underwater power source configured to power module 20 and/or modular unit 64 (and/or other particular implementations of a submersible high illumination light source assembly), when the assembly is operating underwater. In those particular implementations having a separate in-air power source and separate underwater power source (and in other particular implementations), one or more power control units may be provided.

Among other things, the one or more power control units may perform the operations necessary to switch the power source for module 20 and/or modular unit 64 (and/or other particular implementations of a submersible high illumination light source assembly) between an in-air power source and an underwater power source. In some particular implementations, a power cable, universal power source, in-air power source, underwater power source, and/or power control units may be provided within, or may extend from, one or more bases (which may be coupled with one or more mounting brackets 66).

Module 20 and/or modular unit 64 (and/or other particular implementations of a submersible high illumination light source assembly), which can operate both when submerged underwater and exposed to air, may be submerged in an underwater environment. Submerging module 20 and/or modular unit 64 may comprise first providing power to module 20 and/or modular unit 64 in an in-air environment and then submerging module 20 and/or modular unit 64 in an underwater environment while still providing power to module 20 and/or modular unit 64, or providing power to module 20 and/or modular unit 64 after module 20 and/or modular unit 64 have been submerged. In addition, module 20 and/or modular unit 64 may be removed from an underwater environment while still providing power to module 20 and/or modular unit 64.

EXAMPLES

Implementations may be designed to operate at a variety of voltages and wattages and may produce a variety of lumen total outputs, thereby operating with a variety of efficacies. In lighting design, "efficacy" refers to the amount of light (luminous flux) produced by a lamp (a light bulb or other light source), usually measured in lumens, as a ratio of the amount of energy consumed to produce it, usually measured in watts. This is not to be confused with "efficiency" which is always a dimensionless ratio of output divided by input which for lighting relates to the watts of visible energy as a ratio of the energy consumed in watts.

Accordingly, for the exemplary purposes of this disclosure, some submersible high illumination light source assembly implementations may operate at about 40 volts, between about 5 amperes to about 12 amperes, and from about 200 watts to about 500 watts, while other submersible high illumination light source assembly implementations may operate at about 40 volts and from about 450 watts. Likewise, some submersible high illumination light source assembly implementations may operate to produce a lumen total output from about 8,000 lumens to about 120,000 lumens, while other submersible high illumination light source assembly implementations may operate to produce a lumen total output from about 40,000 lumens to about 50,000 lumens. Similarly, some submersible high illumination light source assembly implementations may operate with an efficacy from about 40 lumens per watt to about 500 lumens per watt, while other submersible high illumination light source assembly implementations may operate with an efficacy from about 40 lumens per watt to about 200 lumens per watt.

The following example further illustrates, not limits, this disclosure. An implementation similar to that described with respect to FIGS. 1 and 2 was tested in accordance with Illuminating Engineering Society (IES) procedures. This particular implementation comprised a single LED panel with 144 LEDs and a clear flat quartz glass lens. This implementation was operated at 40 volts DC (5 amperes) and at 204 watts. The following results outlined in the tables below were obtained:

TABLE 1

INTENSITY (CANDLEPOWER) SUMMARY

| ANGLE | ALONG | 22.5 | 45 | 67.5 | ACROSS | OUTPUT LUMENS |
|---|---|---|---|---|---|---|
| 0 | 5932 | 5932 | 5932 | 5932 | 5932 | |
| 5 | 5800 | 5797 | 5797 | 5827 | 5791 | 553 |
| 10 | 5511 | 5511 | 5516 | 5537 | 5509 | |
| 15 | 5170 | 5179 | 5180 | 5193 | 5164 | 1453 |
| 20 | 4812 | 4805 | 4812 | 4824 | 4798 | |
| 25 | 4430 | 4426 | 4424 | 4430 | 4409 | 2031 |
| 30 | 4030 | 4020 | 4029 | 4020 | 4006 | |
| 35 | 3559 | 3560 | 3582 | 3560 | 3546 | 2212 |
| 40 | 3031 | 3027 | 3042 | 3019 | 3013 | |
| 45 | 2297 | 2290 | 2282 | 2283 | 2294 | 1670 |
| 50 | 1049 | 1039 | 1025 | 1021 | 1041 | |
| 55 | 291 | 291 | 296 | 293 | 295 | 358 |
| 60 | 198 | 199 | 202 | 201 | 202 | |
| 65 | 110 | 112 | 115 | 118 | 115 | 119 |
| 70 | 58 | 59 | 63 | 64 | 61 | |
| 75 | 27 | 28 | 28 | 29 | 28 | 33 |
| 80 | 10 | 12 | 12 | 11 | 10 | |
| 85 | 1 | 1 | 1 | 1 | 1 | 3 |
| 90 | 0 | 0 | 0 | 0 | 0 | |

TABLE 2

AVERAGE LUMINANCE DATA
CD./SQ.M. (FOOTLAMBERTS)

| ANGLE | ALONG | 22.5 | 45 | 67.5 | ACROSS |
|---|---|---|---|---|---|
| 0 | 75989 (22178) | 75989 (22178) | 75989 (22178) | 75989 (22178) | 75989 (22178) |
| 30 | 59613 (17395) | 59626 (17402) | 59755 (17440) | 59603 (17396) | 59250 (17293) |

TABLE 2-continued

| AVERAGE LUMINANCE DATA CD./SQ.M. (FOOTLAMBERTS) | | | | | |
|---|---|---|---|---|---|
| ANGLE | ALONG | 22.5 | 45 | 67.5 | ACROSS |
| 40 | 50687 (14793) | 50752 (14812) | 50909 (14858) | 50622 (14774) | 50382 (14704) |
| 45 | 416151 (12146) | 41540 (12124) | 41494 (12110) | 41474 (12104) | 41721 (12176) |
| 50 | 20911 (6103) | 20774 (6063) | 20434 (5964) | 20404 (5955) | 20753 (6057) |
| 55 | 6503 (1898) | 6505 (1898) | 6630 (1935) | 6560 (1914) | 6612 (1929) |
| 60 | 5065 (1478) | 5115 (1492) | 5177 (1511) | 5153 (1504) | 5172 (1509) |
| 65 | 3349 (977) | 3390 (989) | 3512 (1025) | 3574 (1043) | 3513 (1025) |
| 70 | 2162 (631) | 2201 (642) | 2356 (687) | 2401 (700) | 2302 (672) |
| 75 | 1315 (384) | 1403 (409) | 1399 (408) | 1444 (421) | 1403 (409) |
| 00 | 766 (223) | 892 (260) | 892 (260) | 828 (241) | 766 (223) |
| 95 | 122 (35) | 122 (35) | 122 (35) | 122 (35) | 122 (35) |

From the test results, at 40 volts DC and at 204 watts, this implementation generated a total luminaire lumen output of 8431 lumens. This implementation was run at approximately half-power and the total lumen output was essentially half of what was expected. Accordingly, this implementation was able to operate with an efficacy of approximately 41.3 lumens-per-watt. Obviously, if this implementation were run at full power, the expected total luminaire lumen output would be in excess of 16,800 lumens. And if, for example, one was to use three of these implementations in a modular unit, a total lumen output of over 50,400 lumens (16,800+×3) would be expected.

The invention claimed is:

1. A submersible high illumination light source assembly comprising:

at least one module comprising:

a heat sink comprising a front surface and a rear surface;

a printed circuit board in thermal communication with the front surface of the heat sink, the printed circuit board comprising one or more electrical connections sized and shaped to couple with a plurality of high-illumination light emitting diode (LED) lamps;

the plurality of high-illumination LED lamps coupled in electronic communication with the printed circuit board via the one or more electrical connections;

at least one reflector sized and shaped to accept the insertion of one or more of the plurality of high-illumination LED lamps; and a window in watertight communication with the reflector plate; and wherein the submersible high illumination light source assembly operates both when submerged underwater and exposed to air.

2. The assembly of claim 1, further comprising a conformance coating on at least the printed circuit board.

3. The assembly of claim 1, wherein the heat sink contains no copper.

4. The assembly of claim 1, wherein the rear surface of the heat sink comprises a plurality of fins arranged in a vertical orientation.

5. The assembly of claim 1, wherein the at least one reflector comprises a reflector plate comprising a plurality of dimples each sized and shaped to accept the insertion of the plurality of high-illumination LED lamps.

6. The assembly of claim 1, wherein the at least one reflector comprises a plurality of individual reflectors, each sized and shaped to accept the insertion of one of the plurality of high-illumination LED lamps.

7. The assembly of claim 1, wherein the submersible high illumination light source assembly further operates at about 40 volts and from about 200 watts to about 500 watts.

8. The assembly of claim 7, wherein the submersible high illumination light source assembly operates at about 450 watts.

9. The assembly of claim 1, wherein the submersible high illumination light source assembly further operates to produce a lumen total output from about 8,000 lumens to about 120,000 lumens.

10. The assembly of claim 9, wherein the submersible high illumination light source assembly further operates to produce a lumen total output from about 40,000 lumens to about 50,000 lumens.

11. The assembly of claim 1, wherein the submersible high illumination light source assembly further operates with an efficacy from about 40 lumens per watt to about 500 lumens per watt.

12. The assembly of claim 11, wherein the submersible high illumination light source assembly further operates with an efficacy from about 40 lumens per watt to about 200 lumens per watt.

13. The assembly of claim 1, further comprising a thermal paste between the front surface of the heat sink and a rear surface of the printed circuit board.

14. The assembly of claim 1, further comprising a heat sensor operably coupled with the printed circuit board and a power control unit, the heat sensor providing a temperature signal in response to a sensed temperature.

15. The assembly of claim 1, wherein the at least one module comprises at least two modules one of coupled to and integrally joined with one another.

16. A method of operating a high illumination light source assembly comprising:

submerging in an underwater environment the high illumination light source assembly comprising: at least one module having: a heat sink comprising a front surface and a rear surface; a printed circuit board in thermal communication with the front surface of the heat sink, the printed circuit board comprising one or more electrical connections sized and shaped to couple with a plurality of high-illumination light emitting diode (LED) lamps; the plurality of high-illumination LED lamps coupled in electronic communication with the printed circuit board via the one or more electrical connections; at least one reflector sized and shaped to accept the insertion of one or more of the plurality of high-illumination LED lamps; a window in watertight communication with the reflector plate; and wherein the submersible high illumination light source assembly operates both when submerged underwater and exposed to air.

17. The method of claim 16, wherein the step of submerging the high illumination light source assembly comprises providing power to the high illumination light source assembly in an in-air environment and then submerging the high illumination light source assembly in an underwater environment while still providing power to the high illumination light source assembly.

18. The method of claim 17, further comprising removing from the underwater environment the high illumination light source assembly while still providing power to the high illumination light source assembly.

19. The method of claim 16, further comprising providing power to the high illumination light source assembly.

20. The method of claim 19, further comprising removing from the underwater environment the high illumination light source assembly while still providing power to the high illumination light source assembly.

21. The method of claim 16, further comprising operating the high illumination light source assembly at about 40 volts and from about 200 watts to about 500 watts.

22. The method of claim 16, further comprising operating the high illumination light source assembly to produce a lumen total output from about 8,000 lumens to about 120,000 lumens.

23. The method of claim 16, further comprising operating the high illumination light source assembly with an efficacy from about 40 lumens per watt to about 500 lumens per watt.

* * * * *